United States Patent [19]

Parker et al.

[11] 4,355,765

[45] Oct. 26, 1982

[54] WEB GRANULATOR WITH NIP ROLLERS HAVING HOOKING MEMBERS

[76] Inventors: Frank Parker; Leslie M. Parker, both of Old Brandon Rd., Hillsboro, Tex. 76645

[21] Appl. No.: 142,968

[22] Filed: Apr. 23, 1980

[51] Int. Cl.[3] ..... B02C 18/22

[52] U.S. Cl. ..... 241/152 A; 241/158; 241/222

[58] Field of Search ..... 241/101.4, 102, 152 A, 241/155, 158, 222

[56] References Cited

U.S. PATENT DOCUMENTS

| | | | |
|---|---|---|---|
| 2,306,427 | 12/1942 | Christman et al. | 241/102 |
| 2,890,840 | 6/1959 | Fletcher et al. | 241/222 UX |
| 3,019,829 | 2/1962 | Yoerger | 241/158 X |
| 3,552,463 | 1/1971 | Witt | 241/222 |
| 3,817,464 | 6/1974 | Souser | 241/222 |
| 3,829,030 | 8/1974 | Wallenfang et al. | 241/222 X |
| 4,069,981 | 1/1978 | Shah | 241/222 X |
| 4,161,296 | 7/1979 | Parker et al. | 241/152 A |

*Primary Examiner*—Howard N. Goldberg
*Attorney, Agent, or Firm*—James E. Bradley

[57] ABSTRACT

A granulator for comminuting plastic web scrap has features that allow it to also granulate three dimensional objects. The granulator has a pair of nip rollers mounted above a cutter assembly for drawing the web into the cutter assembly. The nip rollers have grabbing devices for grabbing three dimensional objects when they fall onto the rollers, for shredding the objects and forcing them between the rollers. In one embodiment, the grabbing device consists of a groove formed in the surface of at least one of the rollers. The groove has a sharp-edged trailing surface that grabs the article. In another embodiment, the grabbing device consists of a protruding finger that grabs the article. To provide clearance, a circumferential slot is located in the other roller for receiving the finger.

9 Claims, 4 Drawing Figures

WEB GRANULATOR WITH NIP ROLLERS HAVING HOOKING MEMBERS

BACKGROUND OF THE INVENTION

1. Field of the Invention

This invention relates in general to machinery for comminuting scrap articles, and in particular to a device for granulating scrap sheets of plastic after stamping operations.

2. Description of the Prior Art

Certain plastic forming operations utilize presses that pressure or vacuum form articles such as food and drink containers from a web or continuous sheet of plastic drawn through the press. To conserve the plastic material, the scrap or skeleton portion of the web is granulated into small particles for converting back into raw material for reuse.

One type of granulator is located below the press and has a pair of nip rollers for drawing the scrap web into its cutting assembly. Occasionally objects after stamping may fall onto the rollers of the granulator. The rollers are unable to easily feed material other than thin sheets, thus these three dimensional objects may build up on the granulator. Some may be knocked out onto the floor. Eventually the press and the granulator may have to be stopped to remove the scrap objects.

SUMMARY OF THE INVENTION

It is accordingly a general object of this invention to provide an improved web granulator.

It is a further object of this invention to provide an improved web granulator that will draw a web into a cutter assembly, and also grab and force into the cutter assembly any three dimensional objects that fall onto the granulator.

In accordance with these objects, a granulator is provided with a pair of nip rollers. The nip rollers have portions of cylindrical surfaces and are driven in opposite directions so that the surfaces are in rolling contact with each other to draw scrap sheet material between the rollers. At least one of the rollers has grabbing means for seizing a portion of a three dimensional object that may fall onto the rollers. This action tears the object and feeds it into the cutter assembly. The grabbing means is a hook member that is formed on at least one of the rollers. The hook member has a surface facing the direction of rotation for grabbing three dimensional objects. In one embodiment, the hook member consists of a groove formed in a roller that has a trailing wall facing the same direction as the direction of rotation. In another embodiment, the hook member is a finger that protrudes from one of the rollers. The other roller has a circumferential slot for receiving the finger.

DESCRIPTION OF THE PREFERRED EMBODIMENTS

Figure 1:
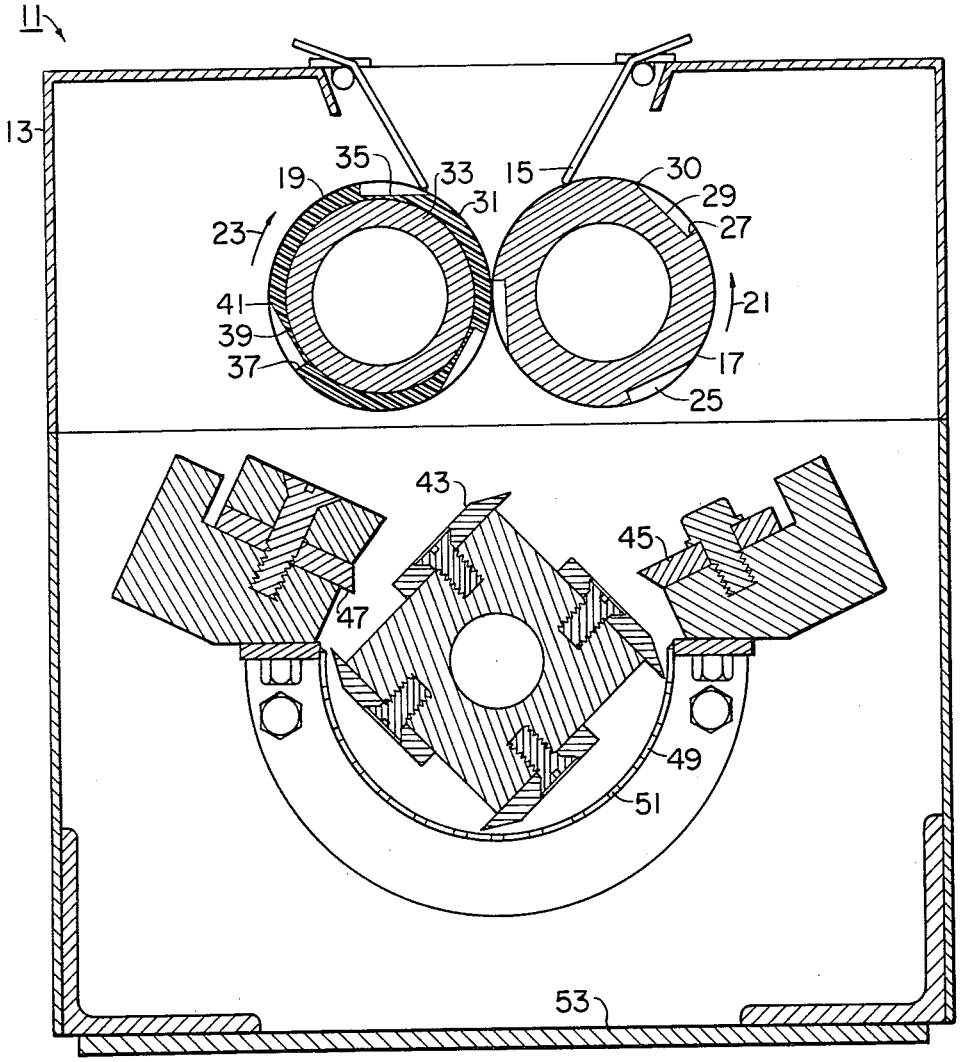
FIG. 1 is a vertical sectional view of a granulator constructed in accordance with this invention.

Referring to FIG. 1, granulator 11 has a housing 13, an open chute 15 is mounted on the top of the housing 13. A pair of nip rollers 17 and 19 are mounted below the chute and are urged toward each other for drawing a sheet (not shown) of scrap material dropped from a press (not shown). Rollers 17 and 19 are driven in opposite directions, as indicated by the arrows 21 and 23. Each roller 17, 19 is cylindrical and equal in diameter to the other.

Roller 17 in the embodiment of FIG. 1 is formed of steel and has a plurality of grooves 25 formed in its surface. Each groove 25 has a trailing wall 27 that is formed in the roller 17 along a radial plane of the axis of roller 17. The trailing wall 27 is a flat surface, with its plane containing radial lines emanating from the axis of rotation of the roller 17. Trailing wall 27 terminates in a bottom surface 29 formed in a plane perpendicular to the trailing wall 27. Bottom surface 29 extends in a single plane to the cylindrical surface of the roller 17, defining a leading edge 30. The leading edge 30 leads the trailing wall 27 considering the direction of rotation. The groove 25 is in a general configuration of a "V", with surface 29 forming one leg of the "V", and the trailing wall 27 forming the other leg of the "V". The intersection of the trailing wall 27 with the cylindrical surface of the roller 17 will be normal to the cylindrical surface, thus creating a sharp hooking member to serve as grabbing means for seizing a portion of a three dimensional scrap object. The leading edge 30 forms an obtuse angle with respect to the cylindrical surface to facilitate entry of a portion of an object into the groove 25.

Figure 2:
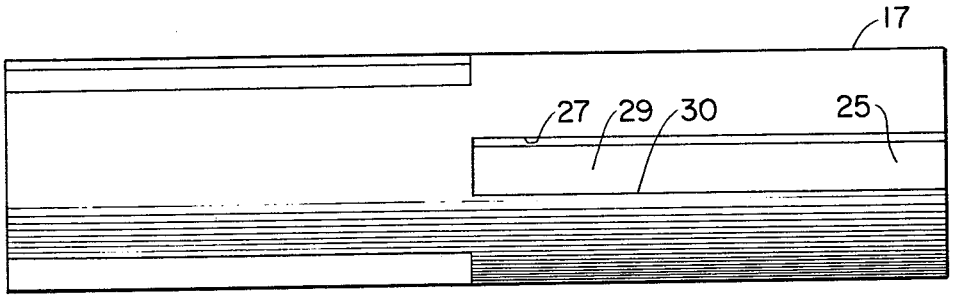
FIG. 2 is a top view of one of the rollers of the granulator of FIG. 1.

As shown in FIG. 2, each groove 25 is parallel with the axis of rotation of roller 17 and extends from one end of roller 17 to the midpoint. In the embodiment of FIG. 1, there are three grooves 25 spaced on the right end of roller 17, these grooves being spaced 120° apart, rotationally. There are also three grooves 25 on the left end of roller 17, these grooves also being spaced apart 120° rotationally. The grooves on the left half of roller 17, however, are staggered, or offset from the grooves on the right side, so that a groove on one end will be located between two grooves on the other end. This results in the grooves on one end being 60° rotationally from the grooves on the other end.

In the embodiment of FIG. 1, roller 19 contains a cylindrical resilient liner 31 secured on a cylindrical steel core 33. Liner 31 is rubberlike, preferably of nitrile material. A plurality of grooves 35 are formed in the liner 31 similar to the grooves 25 in roller 17. Grooves 35 also contain a trailing wall 37, a bottom surface 39, and a leading edge 41. The dimensions and spacing of the grooves 35 are the same as the dimensions and spacing of the grooves 25. The only difference between roller 17 and roller 19 is that roller 19 has the resilient liner 31. The depth of the trailing wall 37 is approximately the thickness of the liner 31.

The rollers 17 and 19 are timed so that a groove 25 does not coincide with a groove 35, as shown in the drawings. That is, at the point where the rollers 17 and 19 rollingly contact each other, a groove 25 will always contact a portion of the cylindrical surface of roller 19, and a groove 35 will always contact a portion of the cylindrical surface of the roller 17. Grooves 25 and 35 will never contact each other. Since grooves 25 and 35 extend only one-half the width of the rollers 17, 19, there will always be two cylindrical portions, one-half the length of the rollers, in contact with each other for gripping the web.

A cutter assembly is mounted below the nip rollers 17 and 19 for comminuting or reducing the scrap into small particles. The cutter assembly includes a plurality of rotor knives 43. In this embodiment, there are four rotor knives 43 mounted parallel with each other and with the rollers 17, 19, in a cylindrical array. Each rotor knife 43 is a sharp-edged blade extending substantially the length of housing 13. In this embodiment, the rotor knives 43 are rotatably driven past two stationary bed knives 45 and 47. The bed knives 45, 47 are mounted parallel with the rotor knives 43 so as to substantially meet the rotor knives 43 as the rotor knives rotate. Bed knives 45, 47 are sharp-edged blades of the same length as the rotor knives 43.

A semi-cylindrical screen 49 is mounted below the rotor knives 43. Screen 49 is perforated with a large number of holes 51 for allowing scrap particles to fall through by gravity. Screen 49 is mounted in close proximity to rotor knives 43 so that particles larger than the holes 51 will be picked up and rotated past the bed knives 45, 47 for further cutting. Screen 49 is slightly larger in diameter than the cylinder defined by the rotor knives 43. The axis of screen 49 coincides with the axis of rotation of rotor knives 43. A collection chamber 53 is defined by the housing below the screen 49. Blowers draw the particles from the collection chamber to a storage facility.

In the operation of the embodiment of FIGS. 1 and 2, the granulator 11 will be located below the press that pressure or vacuum forms the plastic articles (not shown). After an article is formed the press shears off the sheet from which the article was formed. The severed sheet or web drops into chute 15. As the press operates, the rollers 17, 19 will rotate in the directions indicated by arrows 21 and 23, drawing the sheet downwardly and feeding it into the cutter assembly, where rotor knives 43 cut the scrap into small particles. When a three dimensional object falls onto the rollers 17, 19, the grooves 25 and 35 will seize portions of the article and crush it against the opposite roller. Eventually the object is flattened and shredded sufficiently to be forced through the rollers into the cutter assembly for further granulating. "Three dimensional" is used herein to refer to objects that have significant thickness with respect to the width and height, such as a drinking cup. A web or thin sheet material is not considered to be three-dimensional within this definition.

Figure 4:
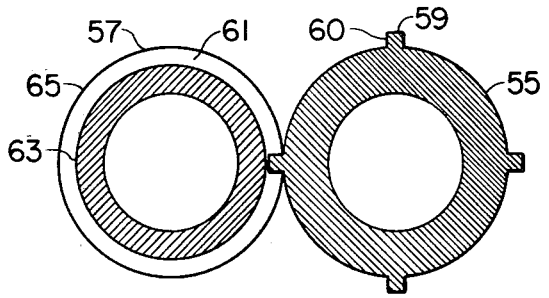
FIG. 4 is a sectional view of the rollers of FIG. 3, taken along the lines IV—IV.
Figure 3:
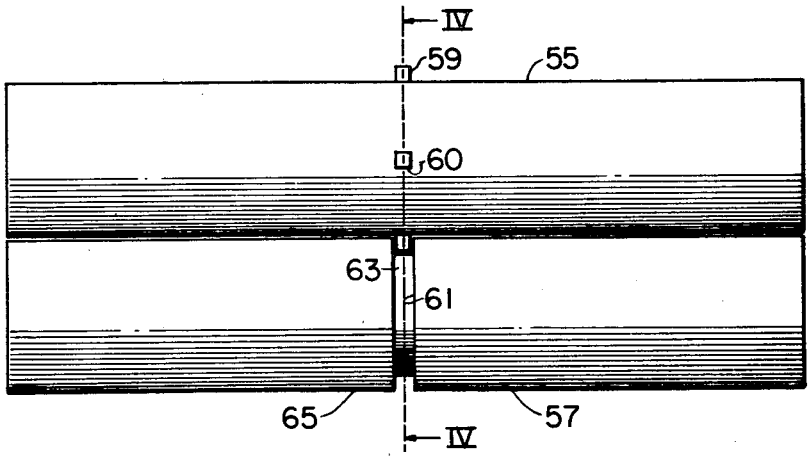
FIG. 3 is a top view of the rollers of an alternate embodiment of a granulator constructed in accordance with this invention.

An alternate embodiment for the nip rollers 17 and 19 is shown in FIGS. 3 and 4, the other portions of the granulator 11 remaining the same. This embodiment includes two nip rollers 55 and 57 that have cylindrical outer surfaces and are rotatably driven in opposite directions to draw a web of scrap material between them. Roller 55 is a steel roller that has one or more circumferential rows (only one shown) of protruberances or fingers 59. Each finger 59 is a rectangular protruberance that protrudes outwardly from the cylindrical surface of the roller 55. Each finger 59 has a surface 60 that lies in a radial plane of the roller 55 and that faces the same direction as the direction of rotation. In the embodiment of FIGS. 3 and 4 there are four fingers 59, each spaced 90° apart. A plane intersecting the four fingers 59 at the midpoint is perpendicular with the axis of roller 55. The length of each finger 59 along the axis of roller 55 is substantially less than the length of the roller. The circumferential thickness of finger 59 is substantially less than the circumference of roller 55 and substantially less than the circumferential space between fingers 59.

The cylindrical surfaces of rollers 55 and 57 are urged toward each other to provide rolling contact. To provide clearance for the fingers 59, a circumferential slot 61 is formed in the outer surface of roller 57. A plane intersecting the center of slot 61 is perpendicular with the axis of roller 57. In the embodiment of FIGS. 3 and 4, roller 57 has a steel core 63 with a rubberlike liner 65, preferably nitrile, formed on its outer surface. The slot 61 extends the full depth of the liner 65.

In the operation of the embodiment of FIGS. 3 and 4, web scrap is drawn between the rollers 55 and 57 by the rolling contact of their cylindrical surfaces. If a three dimensional object falls onto the rollers 55, 57, the finger 59 will serve as a hook member, with its leading surface grabbing the three dimensional objects and pushing them against the roller 57. Once shredded and flattened sufficiently, the object is forced into the cutter assembly.

The invention shown has significant advantages. The nip rollers operate conventionally in drawing web scraps. If a three dimensional object falls onto the web rollers, the grabbing means formed on the rollers will seize a portion of the object and shred and force it into the cutter assembly. This avoids having to periodically clean articles from the vicinity of the press.

While the invention has been shown in only one of its forms, it should be apparent to those skilled in the art that it is not so limited but is susceptible to various changes and modifications without departing from the spirit thereof.

We claim:

1. In a granulator of the type having a cutter assembly for granulating objects into particles, an improved means for forcing scrap material into the cutter assembly, comprising in combination:

a pair of nip rollers mounted adjacent the cutter assembly and driven in opposite directions, the rollers having portions of cylindrical surfaces in rolling contact with each other for drawing scrap sheet material between the rollers and into the cutter assembly; and grabbing means formed on one of the rollers for seizing a portion of a three dimensional scrap object and crushing it against the other roller to tear the object and feed it into the cutter assembly;

the grabbing means comprising a hook member formed on one of the rollers, the hook member having a surface facing the same direction as the direction of rotation for grabbing three dimensional objects; the hook member comprising:

a finger projecting outwardly from one of the rollers, and the other of the rollers having a circumferential slot for receiving the finger during rotation.

2. In an apparatus for granulating a sheet of scrap material into particles, the apparatus being of the type having a cutter assembly with a plurality of rotor knives rotated past a stationary knife, and a perforated screen mounted below the rotor knives having apertures that allow the particles to pass through for collection, an improved means for drawing the sheet into the cutter assembly, comprising in combination:

a pair of nip rollers mounted adjacent the cutter assembly and driven in opposite directions, the rollers having portions of cylindrical surfaces in rolling contact with each other for drawing the sheet between the rollers and into the cutter assembly;

at least one of the rollers having a groove with a leading edge, a bottom surface, and a trailing wall, the trailing wall facing generally the same direction as the direction of rotation for grabbing three dimensional objects that may fall onto the rollers;

the trailing wall of the groove being located on a radial plane of the axis of the roller;

the bottom surface of the groove being perpendicular to the trailing wall, and extending in a single plane to the cylindrical surface, defining the leading edge.

3. In an apparatus for granulating a sheet of scrap material into particles, the apparatus being of the type having a cutter assembly with at least one rotor knife rotated past a stationary knife, an improved means for drawing the sheet into the cutter assembly, comprising in combination:

a pair of nip rollers mounted adjacent the cutter assembly and driven in opposite directions;

at least one of the rollers having a cylindrical surface containing at least one groove with a bottom surface and a trailing wall, the trailing wall facing generally the same direction as the direction of rotation;

the bottom surface being transverse to the trailing wall and intersecting the cylindrical surface at an obtuse angle to define a leading edge, the cylindrical surface being in rolling contact with the other roller.

4. The apparatus according to claim 3 wherein the cylindrical surface contains a plurality of the grooves, and wherein the grooves are spaced-apart so that a portion of the cylindrical surface between two of the grooves is greater in circumferential distance than the width of any of the grooves.

5. In an apparatus for granulating a sheet of scrap material into particles, the apparatus being of the type having a cutter assembly with a plurality of rotor knives rotated past a stationary knife, and a perforated screen mounted below the rotor knives having apertures that allow the particles to pass through for collection, an improved means for drawing the sheet into the cutter assembly, comprising in combination:

a pair of nip rollers mounted adjacent the cutter assembly and driven in opposite directions, the rollers having cylindrical surfaces in rolling contact with each other for drawing the sheet between the rollers and into the cutter assembly;

at least one of the rollers having a plurality of grooves formed in the cylindrical surface for grabbing objects that may fall onto the rollers, each of the grooves having a generally "V" shaped configuration with a trailing wall and a bottom surface formed perpendicular with each other, the trailing wall being located on a radial plane and facing the same direction as the direction of rotation, the bottom surface intersecting the cylindrical surface of the roller to define a leading edge.

6. The apparatus according to claim 5 wherein the grooves are equally spaced apart around the roller and extend only one-half the length of the roller, with some of the grooves extending from one end of the roller to the midpoint of the roller, and other of the grooves extending from the other end of the roller to the midpoint of the roller, the grooves on one end of the roller being rotationally staggered from the grooves on the other end of the roller.

7. The apparatus according to claim 6 wherein the grooves are located on both of the rollers, the rollers being timed to prevent the grooves from one of the rollers from coinciding with the grooves of the other of the roller.

8. In an apparatus for granulating a sheet of scrap material into particles, the apparatus being of the type having a cutter assembly with a plurality of rotor knives rotated past a stationary knife, and a perforated screen mounted below the rotor knives having apertures that allow the particles to pass through for collection, an improved means for drawing the sheet into the cutter assembly, comprising in combination:

a pair of nip rollers mounted adjacent the cutter assembly and driven in opposite directions, the rollers having cylindrical surfaces in rolling contact with each other for drawing the sheet between the rollers and into the cutter assembly;

one of the rollers having a protruberance that protrudes from the cylindrical surface of the roller for grabbing objects that may fall onto the rollers;

the other of the rollers having a circumferential slot formed in the cylindrical surface of the roller for receiving the protruberance, allowing the cylindrical surfaces to remain in rolling contact.

9. The apparatus according to claim 8 wherein the protruberance has a surface that lies in a radial plane of the roller.

* * * * *